US005660601A

United States Patent [19]

Oppenländer et al.

[11] Patent Number: 5,660,601

[45] Date of Patent: Aug. 26, 1997

[54] POLYETHERAMINE-CONTAINING FUELS FOR GASOLINE ENGINES

[75] Inventors: Knut Oppenländer, Ludwigshafen; Wolfgang Günther, Mettenheim; Andreas Henne; Volkmar Menger, both of Neustadt; Rainer Becker, Bad Dürkheim; Wolfgang Reif, Frankenthal; Jürgen Thomas, Fussgönheim; Harald Schwahn, Wiesloch; Erhard Henkes, Einhausen, all of Germany

[73] Assignee: BASF Aktiengesellschaft, Ludwigshafen, Germany

[21] Appl. No.: 526,388

[22] Filed: Sep. 11, 1995

[30] Foreign Application Priority Data

Sep. 9, 1994 [DE] Germany ..... 44 32 038.8

[51] Int. Cl.[6] ..... C10L 1/22

[52] U.S. Cl. ..... 44/433; 44/434

[58] Field of Search ..... 44/433, 434

[56] References Cited

U.S. PATENT DOCUMENTS

| | | | |
|---|---|---|---|
| 3,440,029 | 4/1969 | Little et al. | 44/434 |
| 3,960,965 | 6/1976 | Battersby et al. | 44/434 |
| 4,247,301 | 1/1981 | Honnen | 44/63 |
| 4,332,595 | 6/1982 | Herbstman et al. | 44/433 |
| 4,392,866 | 7/1983 | Sung et al. | 44/433 |
| 4,526,587 | 7/1985 | Campbell | 44/433 |
| 4,527,996 | 7/1985 | Campbell | 44/434 |
| 4,604,103 | 8/1986 | Campbell | 44/434 |
| 4,832,702 | 5/1989 | Kummer et al. | 44/434 |
| 4,859,210 | 8/1989 | Franz et al. | 44/434 |
| 4,964,879 | 10/1990 | Herbstman et al. | 44/434 |
| 5,094,667 | 3/1992 | Schilowitz et al. | 44/434 |
| 5,112,364 | 5/1992 | Rath et al. | 44/434 |

FOREIGN PATENT DOCUMENTS

| | | |
|---|---|---|
| 110 665 | 2/1984 | European Pat. Off. . |
| 310 875 | 4/1989 | European Pat. Off. . |
| 440 248 | 8/1991 | European Pat. Off. . |
| 43 09 074 | 9/1994 | Germany . |

*Primary Examiner*—Ellen M. McAvoy
*Attorney, Agent, or Firm*—Keil & Weinkauf

[57] ABSTRACT

Fuels for gasoline engines contain small amounts of polyetheramines I $$R^1—(OBu)_n—NR^2R^3 \quad (I)$$

where $R^1$ is $C_2$–$C_{30}$-alkyl, $R^2$ and $R^3$, independently of one another, are each hydrogen, $C_1$–$C_8$-alkyl, aminoalkylene of the general formula II $$—R^4—NR^5R^6 \quad (II)$$

or polyaminoalkylene of the general formula III $$—(R^4—NR^5)_m—R^6 \quad (III)$$

where $R^4$ is $C_2$–$C_{10}$-alkylene, $R^5$ and $R^6$, independently of one another, are each hydrogen or $C_1$–$C_8$-alkyl and m is from 2 to 8, Bu is a butylene radical derived from butylene oxide and n is from 12 to 28.

12 Claims, No Drawings

POLYETHERAMINE-CONTAINING FUELS FOR GASOLINE ENGINES

BACKGROUND OF THE INVENTION

1. Field of the Invention

The present invention relates to fuels for gasoline engines, which contain small counts of polyetheramines of the formula I $$R^1—(OBu)_n—NR^2R^3 \quad (I)$$

where $R^1$ is $C_2$–$C_{30}$-alkyl, $R^2$ and $R^3$, independently of one another, are each hydrogen, $C_1$–$C_8$-alkyl, aminoalkylene of the formula II $$—R^4—NR^5R^6 \quad (II)$$

or polyaminoalkylene of the formula III $$—(R^4—NR^5)_m—R^6 \quad (III)$$

where $R^4$ is $C_2$–$C_{10}$-alkylene, $R^5$ and $R^6$, independently of one another, are each hydrogen or $C_1$–$C_8$-alkyl and m is from 2 to 8, Bu is a butylene radical derived from butylene oxide and n is from 12 to 28.

2. Description of the Related Art

EP-A 310 875 discloses polyetheramines of the above type, having alkylene radicals derived from propylene oxide or butylene oxide, as valve-cleaning additives for gasoline fuels. The degree of alkoxylation is stated there as being from 5 to 100, preferably from 5 to 30. An isotridecanol which is reacted with butylene oxide and then aminated with ammonia and has a molecular weight of 730, from which a degree of butoxylation of about 7.5 can be calculated, is described in Example B.

Although such polyetheramines have in principle a good valve-cleaning effect, a further improvement is desirable.

It is an object of the present invention to provide fuel additives which effect such a further improvement.

SUMMARY OF THE INVENTION

We have found that this object is achieved by the fuels defined above and containing polyetheramines I.

$R^1$ is preferably $C_8$–$C_{20}$-alkyl, in particular $C_9$–$C_{15}$-alkyl, especially $C_{11}$–$C_{14}$-alkyl, very particularly preferably $C_{13}$-alkyl. The generally long-chain radical $R^1$ may be linear or, preferably, branched.

If $R^2$ and $R^3$ or one of the radicals $R^2$ or $R^3$ are or is not (poly)aminoalkylene II or III, they or it are or is preferably $C_1$–$C_4$-alkyl, e.g. methyl or ethyl, or in particular hydrogen.

The bridge member $R^4$ is preferably linear or branched $C_2$–$C_4$-alkylene, in particular 1,2-ethylene or 1,3-propylene.

m is an integer and is preferably from 2 to 6, especially from 2 to 4.

$R^5$ and $R^6$ are each preferably $C_1$–$C_4$-alkyl, e.g. methyl or ethyl, or in particular hydrogen.

DESCRIPTION OF THE PREFERRED EMBODIMENTS

In a preferred embodiment of the invention, both radicals $R^2$ and $R^3$ are hydrogen or one of the radicals is hydrogen and the other is 2-aminoethyl, 3-aminopropyl or 3-(N,N-dimethylamino)propyl. The last-mentioned radicals are derived from the diamines 1,2-ethylenediamine, 1,3-propylenediamine and 3-(N,N-dimethylamino)propylamine, respectively.

The degree of butoxylation n is preferably from 18 to 25, in particular from 20 to 23, especially 22. n is an average value for a random distribution of butoxylation products.

The polyetheramines I are advantageously prepared, as described in EP-A 310 875, by reaction of alcohols of the formula $R^1$—OH with butylene oxide, it being possible to use 1,2-butylene oxide, 2,3-butylene oxide, isobutylene oxide or a mixture thereof, and subsequent amination with ammonia or amines of the formula $NHR^2R^3$.

Suitable fuels are leaded and unleaded regular and premium-grade gasolines. The gasolines may also contain components other than hydrocarbons, for example alcohols, such as methanol, ethanol or tert-butanol, and ethers, e.g. methyl tert-butyl ether. In addition to the polyetheramines I to be used according to the invention, the fuels contain, as a rule, further additives, such as corrosion inhibitors, stabilizers, antioxidants and further detergents.

Corrosion inhibitors are generally ammonium salts of organic carboxylic acids, which tend to form films when the starting compounds have an appropriate structure. Amines for increasing the pH are also frequently present in corrosion inhibitors. Heterocyclic aromatics are generally used for preventing corrosion of nonferrous metals.

Examples of antioxidants or stabilizers are in particular amines, such as para-phenylenediamine, dicyclohexylamine, morpholine and derivatives of these amines. Phenolic antioxidants, such as 2,4-di-tert-butylphenol or 3,5-di-tert-butyl-4-hydroxyphenylpropionic acid and derivatives thereof, are also added to fuels.

Furthermore, amides and imides of polyisobutylenesuccinic anhydride, poly(iso)buteneamines, poly(iso)butenepolyamines and long-chain carboxamides and carboximides may be present as carburetor, injector and valve detergents in the fuels.

Mineral oils of the viscosity range SN 500–900, as well as brightstock and synthetic oils, such as poly-alpha-olefins, trimellitic esters or polyethers, may be used as carrier oils for concentrates of the polyetheramines I to be used according to the invention. The esters should contain very long-chain branched alcohols of more than 8 carbon atoms in the molecule, and the polyethers should preferably contain long-chain initiators and have high propylene oxide or butylene oxide contents in the molecule.

The fuels contain the polyetheramines I as a rule in amounts of from 10 to 200 ppm, based on the pure polyetheramine. However, as little as from 20 to 1000 ppm, preferably from 40 to 400 ppm, are generally sufficient.

The polyetheramines I to be used according to the invention serve in the fuels mainly as valve-cleaning additives, i.e. as detergents. However, they may also partly perform the function of carrier oils for further detergents.

The fuels described may contain a certain polyetheramine I or a mixture of a plurality of polyetheramines I.

The action of the polyetheramines I in the engine is illustrated below.

PREPARATION EXAMPLES

According to the general methods EP-A 310 875 for the preparation of polyethers by alkali-catalyzed oxyalkylation and for the preparation of polyetheramines by reaction of these polyethers with ammonia under reducing conditions, the three polyetheramines A, B and C were obtained by reacting 1 mol of isotridecanol (from tetrameric propylene) with Example A: 8 mol of 1,2-butylene oxide (for comparison)

Example B: 22 mol of 1,2-butylene oxide (according to the invention)

Example C: 35 mol of 1,2-butylene oxide (for comparison)

and then carrying out amination with $NH_3/H_2$/Raney nickel.

Engine test

The engine test was carried out on an Opel Kadett 1.2 l engine using the cyclic test program CEC-F-04-A-87. The total test time was 40 hours. The gasoline used was commercial unleaded premium-grade gasoline and the engine oil used was the reference oil RL-139.

The evaluation of the intake valves was carried out gravimetrically. For this purpose, the intake valves were removed and their lower surface was carefully mechanically freed from deposits from the combustion space. Thereafter, superficially adhering, readily soluble components on the valves were removed by immersion in cyclohexane and the valves were dried in the air by waving. This treatment was carried out twice altogether. The intake valves were then weighed. The amount of deposits per intake valve was obtained from the weight difference between the valve weights before and after the experiment. The results of these experiments are shown in the table below.

| Example No. | Polyetheramine | Valve deposit mg/intake valve |
|---|---|---|
| 1 | none (base value | 491 |
| 2 | A | 294 |
| 3 | B | 19 |
| 4 | C | 283 |

We claim:

1. A fuel for gasoline engines comprising gasoline and a small amount of a polyetheramine of the formula I $$R^1—(OBu)_n—NR_2R^3 \quad (I)$$

where $R^1$ is $C_2$–$C_3$-alkyl, $R^2$ and $R^3$, independently of one another, are each hydrogen, $C_1$–$C_8$-alkyl, aminoalkylene of the formula II $$—R^4—NR^5R^6 \quad (II)$$

or polyaminoalkylene of the formula III $$—(R^4—NR^5)_m—R^6 \quad (III)$$

where $R^4$ is $C_2$–$C_{10}$-alkylene, $R^5$ and $R^6$, independently of one another, are each hydrogen or $C_1$–$C_8$-alkyl and m is from 2 to 8, Bu is a butylene radical derived from butylene oxide and n is from 12 to 28.

2. A fuel as defined in claim 1, containing a polyetheramine I in which $R^1$ is a branched $C_9$–$C_{15}$-alkyl radical.

3. A fuel as defined in claim 1, containing a polyetheramine I in which both radicals $R^2$ and $R^3$ are hydrogen or one of the radicals $R^2$ and $R^3$ is hydrogen and the other is 2-aminoethyl, 3-aminopropyl or 3-(N,N-dimethylamino) propyl.

4. A fuel as defined in claim 1, containing a polyetheramine I in which the degree of butoxylation n is from 20 to 23.

5. A fuel as defined in claim 1, containing from 10 to 2000 mg of a polyetheramine I per kg of fuel.

6. A method of cleaning the valves of a gasoline engine which comprises running the engine on a fuel as defined in claim 1.

7. A fuel as defined in claim 1, wherein $R^1$ of the polyetheramine I is a branched $C_9$–$C_{15}$-alkyl radical and n is 18 to 25.

8. A fuel as defined in claim 1, wherein $R^1$ of the polyetheramine I is a branched $C_9$–$C_{15}$-alkyl radical and n is 20 to 23.

9. A fuel as defined in claim 1, wherein $R^1$ of the polyetheramine I is a branched $C_9$–$C_{15}$ -alkyl radical and n is 22.

10. A fuel as defined in claim 1, wherein $R^1$ of the polyetheramine I is a branched $C_9$–$C_{15}$ -alkyl radical, both radicals $R^2$ and $R^3$ are hydrogen or one of the radicals $R^2$ and $R^3$ is hydrogen and the other is 2-aminoethyl, 3-aminopropyl or 3-(N,N-dimethylamino)propyl and n is 18 to 25.

11. A fuel as defined in claim 1, wherein $R^1$ of the polyetheramine I is a branched $C_9$–$C_{15}$-alkyl radical, both radicals $R^2$ and $R^3$ are hydrogen or one of the radicals $R^2$ and $R^3$ is hydrogen and the other is 2-aminoethyl, 3-aminopropyl or 3-(N,N-dimethylamino)propyl and n is 20 to 23.

12. A fuel as defined in claim 1, wherein $R^1$ of the polyetheramine I is a branched $C_9$–$C_{15}$-alkyl radical, both radicals $R^2$ and $R^3$ are hydrogen or one of the radicals $R^2$ and $R^3$ is hydrogen and the other is 2-aminoethyl, 3-aminopropyl or 3-(N,N-dimethylamino)propyl and n is 22.

* * * * *

UNITED STATES PATENT AND TRADEMARK OFFICE

CERTIFICATE OF CORRECTION

PATENT NO.: 5,660,601

DATED: August 26, 1997

INVENTOR(S): OPPENLAENDER et al.

It is certified that error appears in the above-identified patent and that said Letters Patent is hereby corrected as shown below:

Column 3, claim 1, line 42, "$NR_2R^3$" should be --$NR^2R^3$--.

Column 3, claim 1, line 45, "$C_2$-$C_3$-alkyl" should be --$C_2$-$C_{30}$-alkyl--.

Signed and Sealed this

Eleventh Day of November, 1997

Bruce Lehman

*Attest:*

BRUCE LEHMAN

*Attesting Officer*

*Commissioner of Patents and Trademarks*